United States Patent [19]

Cooper et al.

[11] 4,334,131

[45] Jun. 8, 1982

[54] MULTI-STAGE PRESSURE SWITCH

[75] Inventors: Steven R. Cooper, Elkhart, Ind.; Kenneth L. Shaw, Edwardsburg, Mich.

[73] Assignee: CTS Corporation, Elkhart, Ind.

[21] Appl. No.: 172,361

[22] Filed: Jul. 18, 1980

[51] Int. Cl.[3] ..... H01H 35/38

[52] U.S. Cl. ..... 200/82 R; 338/39; 200/81.4

[58] Field of Search ..... 338/39; 200/81 R, 81.4, 200/82 R, 82 D; 73/308, 313; 340/626

[56] References Cited

U.S. PATENT DOCUMENTS

| | | | |
|---|---|---|---|
| 2,127,429 | 8/1938 | Schoepf | 338/39 |
| 2,898,566 | 8/1959 | Bacca | 338/39 |
| 2,899,516 | 8/1959 | Smith | 200/81 R |
| 3,002,063 | 9/1961 | Giladett | 200/81.4 |
| 3,069,645 | 12/1962 | Henke | 338/39 |
| 3,284,595 | 11/1966 | Heath | 200/82 R |
| 3,746,810 | 7/1973 | Parsons | 200/81 R |
| 4,150,264 | 4/1979 | Lieberman | 200/81 H |
| 4,152,559 | 5/1979 | Davis | 200/82 R |

FOREIGN PATENT DOCUMENTS

| | | |
|---|---|---|
| 2219928 | 10/1973 | Fed. Rep. of Germany . |
| 2756190 | 6/1979 | Fed. Rep. of Germany . |
| 563193 | 11/1922 | France . |
| 1412194 | 10/1975 | United Kingdom . |

*Primary Examiner*—Gerald P. Tolin

*Attorney, Agent, or Firm*—Larry J. Palguta; John A. Young

[57] ABSTRACT

A multi-stage pressure switch (10) transduces partial vacuum pressure levels to corresponding electrical outputs. The switch (10) comprises a vacuum housing (12) having a bore (16) therein and a port (14) at one end. Positioned within the bore (16) and in engagement with one end of a coaxial spring (48), is a rubber piston (50) having an integral lip seal (54) which wipably engages the wall of the bore, the piston (50) also having a socket (56) disposed therein. A U-shaped switch drive arm (38) has a drive arm extension (40) and ball (41) received within the socket (56) of the rubber piston (50). Contactors (42, 43, and 44,45) are mounted on opposite sides of the drive arm (38). A switch housing (28) having two sets of terminals (32, 33, and 34,35) extending into the housing and terminating at different levels is joined with the vacuum housing (12). A partial vacuum created in the vacuum housing by withdrawal of atmosphere through the port (14) draws the rubber piston (50) against the opposing force of the spring (48). As atmosphere re-enters the vacuum housing (12), the spring (48) displaces the rubber piston (50) toward the switch housing and the first set of contactors (42,43) engages its associated first set of terminals (32,33), completing a circuit and effecting a first electrical output. Further reintroduction of atmosphere results in further movement of the piston (50) and the second set of contactors (44,45) engaging the second set of terminals (34,35) to produce a second electrical output.

15 Claims, 3 Drawing Figures

MULTI-STAGE PRESSURE SWITCH

DESCRIPTION

This invention relates to a multi-stage switch operated by a pressure differential existing between a partial vacuum and atmospheric pressure.

In the operation of automotive engines, it is important that a failure of vacuum pressure in the intake manifold be compensated for by the automatic actuation of an auxiliary vacuum pump, and then, upon further failure of vacuum pressure, energization of a warning light.

Another embodiment comprises a pressure differential transducer which effects variable and digital electrical outputs.

BACKGROUND ART

The advent of smaller, more fuel efficient cars has resulted in smaller engines which must provide the power demands of the vehicle. Small engines must maintain pressure for operating power steering controls etc., and maintain operating pressure at varying altitudes as the ambient pressure decreases. Thus, an inexpensive, easily constructed pressure differential switch which will actuate other devices in sequential stages or steps as the intake manifold pressure decreases, is needed. The pressure responsive switch will sense a failure or inadequacy of manifold vacuum pressure and transduce the changing differential of pressure into electrical outputs which will first actuate an auxilary vacuum pump and then second, actuate a warning light. Prior art vacuum switches are characterized by switches which contain a large number of parts and require many steps of assembly, thereby resulting in higher costs for manufacturing such switches. U.S. Pat. No. 2,899,516 entitled, "VACUUM OPERATED SWITCH," issued Aug. 11, 1959, describes a vacuum switch connected to the intake manifold of an automobile engine so that when the car stalls out in heavy traffic, the resulting failure of intake manifold pressure will cause the switch to actuate a starting circuit and automatically restart the engine when the gear shift lever is put into neutral. This vacuum operated switch requires a large number of parts for assembly and a corresponding high manufacturing cost because of the complexity of the switch. U.S. Pat. No. 3,746,810 entitled, "PRESSURE OPERATED ELECTRIC SWITCHES WITH FLEXIBLE HELICAL BRIDGING CONTACT," issued July 17, 1973, describes a pressure operated switch which must overcome opposing biasing forces and when a reduction in pressure occurs, the switch engages terminals in two steps. Again, this switch construction requires a multiplicity of parts and assembly steps leading to a corresponding higher production cost. Therefore, it is desired to produce an economically manufactured pressure differential switch comprising a minimum number of components and associated assembly steps.

DISCLOSURE OF THE INVENTION

A multi-stage pressure operated switch consists of a vacuum housing having an internal bore and port disposed at one end of the bore. Mounted within the bore is a coaxial spring, one end being disposed about an interior extension of the port and the other end engaging a flange of a rubber piston. The rubber piston is generally annular in shape and has an integral lip seal about the perimeter thereof, the lip seal being in rubbing engagement with the wall of the bore. A U-shaped switch drive arm has a drive arm extension and ball mounted upon one end, the ball being received in a socket of the piston. A switch housing has two sets of terminals mounted therein, each set of terminals extending from the housing for connection to external electrical circuits, and the other ends of the terminals extending for different lengths along the interior walls of the switch housing. The switch drive arm is received in and guided by transverse drive arm guide posts extending into the switch housing. Contactors are mounted on opposite sides of the drive arm and are positioned for engagement with their respective set of terminals. As atmosphere is removed from the vacuum housing, the rubber piston is drawn against the spring and moves in a direction toward the port, disengaging each set of contactors from its respective terminals. As atmosphere is reintroduced into the bore of the vacuum housing, the spring displaces the rubber piston and the sets of contactors successively engage their respective terminals according to the length of the terminals. In another embodiment, contactor wipably engages a resistance element disposed in the lower housing to effect a variable or digital electrical output.

BEST MODE FOR CARRYING OUT THE INVENTION

Figure 1:
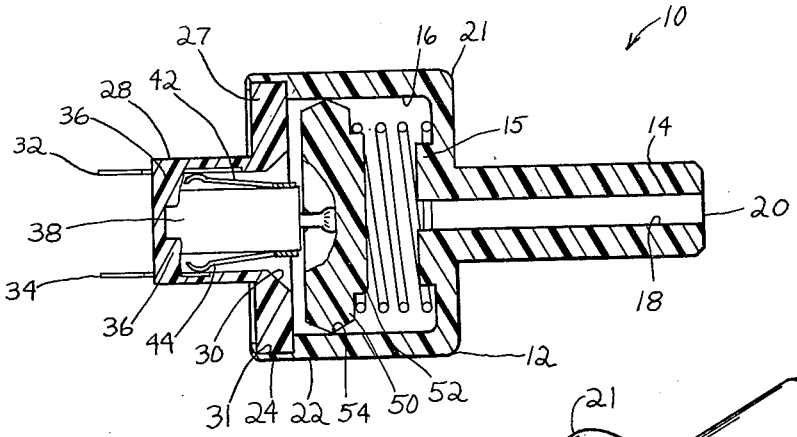
FIG. 1 is a section view of the switch.
Figure 2:
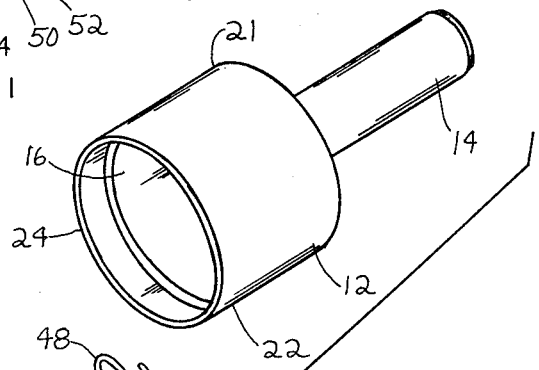
FIG. 2 is an exploded isometric view of the switch of FIG. 1.
Figure 3:
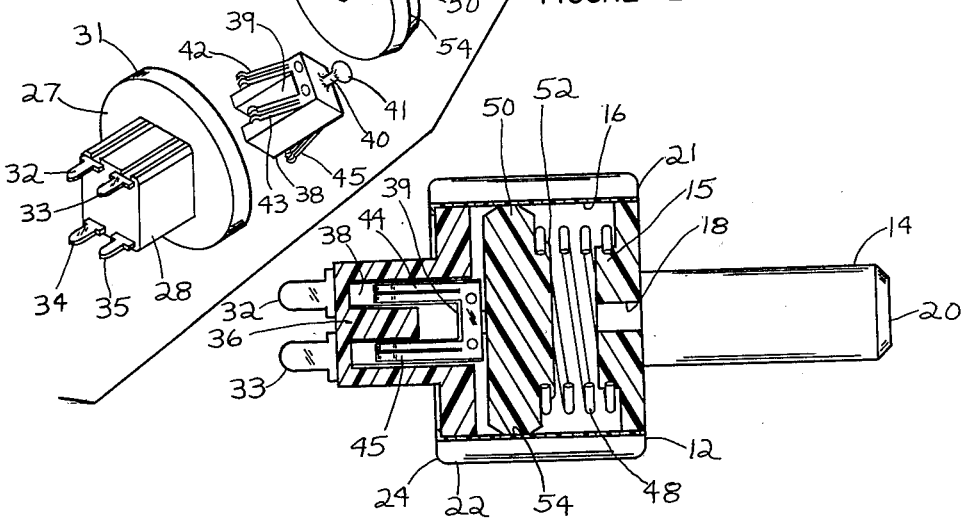
FIG. 3 is a cut-away side view of the switch.

Referring now to FIGS. 1–3, the multistage pressure switch is designated generally by reference numeral 10, with the vacuum housing 12 having a port 14 extending from one end thereof. Vacuum housing 12 contains an internal bore 16 which communicates with an internal port passage 18, the port passage communicating with port aperture 20. Housing 12 contains at the end 22 an annular flange 24 adapted for joining another housing section to the vacuum housing, as will be hereinafter described.

A switch housing 28 having an opening 30 therein and a base 27 contains the electrical components of the switch. Two sets of terminals are mounted in the switch housing. A first set of terminals 32, 33 extends into terminal slots and along the interior wall of the switch housing, each terminal of the first set having portions extending beyond the bottom of the switch housing for connection to an external circuit. A second set of terminals 34, 35 is also mounted in terminal slots in the switch housing 28 and extend along a wall opposite from said first set of terminals, and likewise have portions extending beyond the bottom surface of the switch housing for connection to an external circuit. Integral with the switch housing 28 and extending transversely into the opening 30 are drive arm guide posts 36.

The base 27 has a lip 31 which is received in the flange 24. The vacuum housing 12 may consist of a plastic material, so that once the lip 31 is received in the flange 24, the flange 24 may be heat sealed to further strengthen the securement of the switch housing to the vacuum housing. However, the seal between the base and the flange still allows atmosphere to enter or exit the switch housing as a rubber piston 50 moves in the internal bore of the vacuum housing, as will hereinafter be described.

A U-shaped drive arm 38 has a drive arm extension 40, ball 41, a first set of switch contactors 42, 43, and a second set of switch contactors 44, 45. The first (42, 43) and second (44, 45) set of switch contactors are resiliently formed for wipable engagement with their associated set of terminals. The U-shaped switch drive arm 38 is positioned within the switch housing 28 such that the drive arm slot 39 receives the drive arm guide posts 36, the purpose of the posts being to guide the switch drive arm as it reciprocates in the switch housing. Positioned within the vacuum housing 12 is a coaxial spring 48, one end abutting the interior of end 21 of the vacuum housing and circumposing flange 52 of the rubber piston 50. The rubber piston has an integral lip seal 54 circomposing the perimeter of the piston. Socket 56 in the rubber piston 50 is designed to receive the ball 41 of the switch drive arm 38. The integral lip seal engages the wall of the internal bore 16. It is an important feature of this invention that as atmosphere is exhausted from the vacuum housing and creating a partial vacuum therein, the integral lip seal senses the partial vacuum and is pulled more tightly against the wall of the internal bore, thereby increasing the seal between the rubber piston and bore wall and preventing leakage of atmosphere into that portion of the bore situated between the top of the rubber piston and the port extension 15. Equally important is the ball and socket design of the switch arm and rubber piston, which allows independent alignment between the sets of switch contactors and their associated terminals. Once assembled, the vacuum switch consists of the spring 48 biasing the rubber piston 50 towards the switch housing 28, the integral lip seal 54 providing a seal between the vacuum housing 12 and the switch housing 28. The switch drive arm 38 is secured to the piston 50 by the ball and socket arrangement and will move therewith, the drive arm 38 receiving the drive arm guide posts 36 to assist in maintaining the alignment of the switch contactors with their respective terminals. The first set of switch contactors 42, 43 complete a circuit across the terminals 32, 33, and the second set of switch contactors 44, 45 complete a circuit across the second set of terminals 34,35. The second set of terminals 34,35 are of a shorter length than the first set of terminals 32, 33, and each set of terminals is connected to an external circuit for actuation of a device at a respective partial vacuum pressure. Thus, the pressure switch is a multistage switch responsive to the change in the pressure differential existing between the pressure within the vacuum housing and the ambient pressure, and completing electrical circuits in stages corresponding to predetermined pressure differential levels.

OPERATION

The multi-stage pressure switch 10 is responsive to the differential pressure existing between the pressure in the vacuum housing 12 and atmospheric pressure. The port 14 may be connected to the intake manifold of an automotive engine via a tube (not shown) which connects the intake manifold with the aperture 20. As atmosphere is drawn out of the vacuum housing by the intake manifold, i.e., that is atmosphere is drawn out of the vacuum housing through the port passage 18 into the not shown tube, the rubber piston 50 is drawn towards the port 14. The integral lip seal 54 senses the partial vacuum in the vacuum housing 12 and is drawn into closer engagement with the wall of the internal bore 16, thereby preventing atmosphere contained in the switch housing, and also atmosphere entering the switch housing, from being drawn into the portion of the vacuum housing situated on the other side of the rubber piston 50.

As the rubber piston is drawn towards the port 14, the switch drive arm follows and the second set of switch contactors 44, 45 disengages the second set of terminals 34, 35, thereby opening the associated external circuit. As the rubber piston is drawn further, the first set of switch contactors 42, 43 disengages the first set of terminals 32, 33, thereby opening the circuit between terminals 32, 33. Outside atmosphere is allowed to enter the switch housing through the base-flange fitting and the terminal slots, the slow ingress or egress of atmosphere providing a damping effect. The first set of terminals 32, 33 is connected via an electrical circuit to an auxiliary vacuum pump, and the second set of terminals 34, 35 are connected via an electrical circuit to a warning light contained in the dash board of the automobile.

The object of the present invention is to compensate for failure of vacuum pressure in the intake manifold by actuating, in stages, first the auxilary vacuum pump, and then upon further failure of vacuum pressure, the vacuum warning light contained on the dash board. This is achieved in the following manner. When the engine is not running, the spring biases the rubber piston towards the switch housing and the switch contactors engage their associated terminals. When the engine is started, atmosphere is withdrawn from the vacuum housing through the port and port passage, causing the piston to be drawn against the force of the spring. As the rubber piston moves toward the port, the switch contactors disengage their respective terminals, in the sequence of the second set disengaging the second terminals first and then the first set of contactors disengaging the first set of terminals. While the engine is running, the rubber piston is maintained at an operating position where none of the contactors engage their respective terminals. However, when vacuum pressure begins to fail, atmosphere is reintroduced through the port passage 18 into the vacuum housing 12, and the spring 48 returns the rubber piston 50 towards the switch housing. In stage one, the first set of switch contactors 42, 43 engage the first set of terminals 32, 33 thereby completing a circuit across the terminals and actuating the auxilary vacuum pump. If the vacuum pump succeeds in effecting the desired vacuum pressure within the engine, atmosphere will be withdrawn from the vacuum housing, the piston will return to its operating position, and in doing so the auxilary vacuum pump will be disengaged when the circuit is opened. If the auxilary vacuum pump does not succeed in effecting the desired vacuum pressure in the engine and the vacuum pressure continues to fail, then more atmosphere will enter the vacuum housing and allow the rubber piston to be displaced further toward the switch housing so that the second stage occurs wherein the second set of switch contactors 44, 45 then engage the second set of terminals 34, 35 and thereby complete a circuit to energize the warning light, which will indicate to the automotive operator a loss of vacuum pressure within the engine.

The simplicity of the multistage pressure switch lends to a very low cost device which is easily manufactured and assembled. It is anticipated that the basic concepts of the switch may be altered so that the switch can be a fluid pressure operated switch by placing the spring on the opposite side of the rubber piston so that the piston responds to fluid pumped in the through the port, or by placing a spring on both sides of the rubber piston so that the piston will be responsive both to pressure and vacuum. The switch can also be designed to be responsive to internal pressure differentials by placing another port in the switch housing for removing or introducing fluids. Also, the electrical output may be modified to produce other than a stepped or multi-stage output. For example, a resistance element may replace a set of terminals so that as the contactor wipably engages the resistance element, a variable electrical output is obtained. Also, by making appropriate changes in the pattern of resistive material deposited on the substrate of the resistance element, a digital electrical output may be achieved. Thus, it is possible through the design of the present invention, to provide a multiplicity of pressure operated switch devices and transducers which are responsive to various pressure differentials and also provide a variety of electrical outputs. This may be accomplished with the additional advantage of ease and economy of manufacture because of the simplicity and minimum number of parts required for the switch.

INDUSTRIAL APPLICABILITY

The pressure transducer of the present invention may be utilized to effect multi-stage electrical switching functions, and to effect variable and digital electrical outputs.

CONCLUSION

Although the present invention has been illustrated and described in connection with the example embodiment, it will be understood that this is illustrative of the invention, and it is by no means restrictive thereof. It is reasonably to be expected that those skilled in the art can make numerous revisions and additions of the invention and it is intended that such revisions and additions will be included within the scope of the following claims as equivalents of the invention.

We claim:

1. A fluid pressure differential switch, comprising an annular cover housing having an internal bore, a switch housing secured to the cover housing, a resilient means disposed in said cover housing, a circular piston disposed in the bore of said cover housing and having an integral seal about the circumference of the piston and in sealing and sliding contact with the surface of said bore, a switch drive arm having a first contactor mounted thereon and a switch arm extension and ball, said piston having a socket disposed therein and receiving said ball to universally connect the switch drive arm to the piston, and first terminals disposed inside said switch housing and extending outwardly from said switch housing, said resilient means biasing said piston in response to changes in fluid pressure differential effecting movements of said piston along said bore whereby said contactor engages and disengages from said first terminals.

2. The pressure differential switch in accordance with claim 1, wherein said seal comprises an integral lip seal circumposing said piston and consisting of a composition whereby said integral lip seal senses changes in fluid pressure.

3. The pressure differential switch in accordance with claim 1, further comprising a second contactor and a second set of terminals, said first terminals being of a greater length than said second set of terminals whereby said first contactor wipably engages said first terminals prior to said second contactor engaging the second set of terminals.

4. The pressure differential switch in accordance with claim 1, further comprising a port integral with said cover housing.

5. The pressure differential switch in accordance with claim 1, wherein said switch housing contains a drive arm guide means guiding said switch drive arm.

6. The pressure differential switch in accordance with claim 1, wherein said first contactor includes resilient contactor fingers for wipably engaging said first terminals.

7. A fluid pressure differential transducer, comprising an annular cover housing, a second housing secured to the cover housing, a resilient means disposed in said cover housing, a circular piston disposed in said cover housing and having an integral seal in rubbing contact with an interior surface of said cover housing, a drive arm having a contactor mounted thereon and an arm extension and ball, said piston having a socket disposed therein receiving said ball to universally connect the drive arm to the piston, an electrical circuit means disposed in said second housing, said resilient means biasing said piston in response to changes in fluid pressure differential effecting movement of said piston in said cover housing whereby said contactor wipably engages said electrical circuit means to transduce said changes in fluid pressure differential to an electrical output.

8. The pressure differential transducer in accordance with claim 7, wherein the contactor terminates said electrical output when said contactor wipably disengages said circuit means.

9. A process for transducing a change in fluid pressure differential to an electrical response, comprising the steps of disposing a first contactor in alignment with a first set of terminals, the contactor being mounted upon a drive arm universally connected to an annular piston, said drive arm having a drive arm extension and ball and the piston having a socket receiving the ball, said drive arm and piston being located in oppositely disposed chambers and the annular piston having an integral seal about the circumference of the piston and in rubbing contact with the surface of its associated chamber, selectively effecting one of removing and introducing fluid in one of said chambers, drawing said piston in one direction along its associated chamber, opposing said movement by a resilient means, selectively effecting one of introducing and removing fluid in one of said chambers, and displacing said piston in the opposite direction along said associated chamber whereby the movement of said piston effects one of engagement and disengagement of said first contactor with said a first set of terminals.

10. The process in accordance with claim 9, including the step of the seal wipably engaging the surface of the associated chamber whereby the selective removal and introducing of a fluid in one of said chambers is sensed by said seal and effects a strengthened engagement between the seal and the surface of the associated chamber.

11. The process in accordance with claim 9, further comprising the step of providing a drive arm guide means for guiding the movement of said drive arm.

12. The process in accordance with claim 9, further comprising the steps of disposing a second set of contactors in alignment with a second set of terminals and effecting the successive engagement of the first contactor with the first set of terminals and the second contactor with the second set of terminals.

13. The process in accordance with claim 9, wherein one of said chambers comprises a variable pressure chamber and the other chamber comprises an ambient pressure chamber, and the steps of removing and introducing fluid occur in said variable pressure chamber and effect the movement of said piston.

14. A process for transducing a change in fluid pressure differential to an electrical response, comprising the steps of locating a drive arm and an annular piston in oppositely disposed chambers, the annular piston having an integral seal about the circumference of the piston and wipably engaging the surface of its associated chamber and the drive arm having a contactor mounted thereon, disposing the contactor in alignment with an electrical circuit means, said drive arm having a drive arm extension and ball and the piston having a socket receiving said ball to form a universal connection between said annular piston and drive arm, selectively effecting one of removing and introducing fluid in one of said chambers, drawing said piston in one direction along its associated chamber and opposing the movement by a resilient means, selectively effecting one of introducing and removing fluid in one of said chambers, and displacing said piston in the opposite direction along its associated chamber whereby the movement of said piston effects one of wipable engagement and disengagement of said contactor with said electrical circuit means.

15. The process in accordance with claim 14, wherein the engagement of said contactor and circuit means effects an electrical output.

* * * * *